United States Patent [19]

Stuckmann et al.

[11] 4,120,165

[45] Oct. 17, 1978

[54] METHODS OF AND APPARATUS FOR DRIVING TUNNELS

[75] Inventors: Dieter Stuckmann, Selm; Hans Jütte, Dortmund-Brechten, both of Fed. Rep. of Germany

[73] Assignee: Gewerkschaft Eisenhutte Westfalia, Lunen, Fed. Rep. of Germany

[21] Appl. No.: 767,930

[22] Filed: Feb. 11, 1977

[30] Foreign Application Priority Data

Feb. 13, 1976 [DE] Fed. Rep. of Germany ..... 2605741
Feb. 13, 1976 [DE] Fed. Rep. of Germany ..... 2605740

[51] Int. Cl.[2] ..... E01G 3/02

[52] U.S. Cl. ..... 405/145; 405/146; 405/150

[58] Field of Search ..... 61/85, 84, 45 R

[56] References Cited

U.S. PATENT DOCUMENTS 3,950,956 4/1976 Lobbe ..... 61/85
4,022,029 5/1977 Jutte et al. ..... 61/84
4,043,137 8/1977 Jütte et al. ..... 61/85

*Primary Examiner*—Jacob Shapiro
*Attorney, Agent, or Firm*—Sughrue, Rothwell, Mion, Zinn and Macpeak

[57] ABSTRACT

Apparatus for driving tunnels or the like employs a drive shield known per se, with drive members supported and guided on a frame. Rear extension members are linked to the drive members, preferably through units permitting relative displacement therebetween and these rear members form a rear shield for receiving supports and reinforcements for a permanent lining for the tunnel. A concrete spraying nozzle or the like applies a strip of concrete to the tunnel wall each time a rear member is shifted in the advancing direction. In this way a series of strips, preferably shape locked together at their ends, can be built up stage by stage to create the lining.

20 Claims, 9 Drawing Figures

METHODS OF AND APPARATUS FOR DRIVING TUNNELS

BACKGROUND TO THE INVENTION

The present invention relates in general to a method of, and apparatus for driving tunnels or other excavations all referred to hereinafter for convenience as "tunnels."

It is known to produce tunnels with the aid of a drive shield composed of drive members or cutters supported on a frame and advanced in succession by hydraulic rams. Various techniques have been adopted to facilitate support of the resulting tunnel wall and the formation of a permanent lining for the tunnel wall. Thus, it is known to provide each drive member of the drive shield with a rear extension sometimes called a rear tail. These rear extensions form a rear protective shield which supports the wall between the drive shield and the lining. As the rear extensions are moved up temporary or preliminary support is provided for the wall. To this end it is known, especially with loose soil, to seal the wall exposed by the rear extensions with the aid of a sealant, usually sprayed fluid concrete, which may form part of the final support lining. It is also known to introduce arches or rings into the rear shield to facilitate the support of the rear extensions and the tunnel wall.

A general object of the present invention is to provide an improved method and apparatus for driving tunnels.

SUMMARY OF THE INVENTION

In its broadest aspect the invention provides a method of driving a tunnel or the like which utilizes a drive shield with a plurality of drive members individually displaceable and supported by frame means and rear tail members associated and movable with the drive members wherein a lining for the tunnel is created to the rear of the drive shield by introducing concrete in successive strips into the spaces left as the rear tail members are advanced.

In a method of producing a lining for an underground tunnel or the like by introducing fluid concrete into a region at the rear side of a drive shield the invention also provides for introducing fluid concrete in successive strips side-by-side to combine and form a continuous lining, each strip corresponding to the gap left when a rear tail extension of one of the drive members of the shield is advanced.

In performing the method of the invention, the concrete strips can be produced by spraying fluid concrete and each part of the tunnel wall exposed as the associated rear tail member advances can be immediately sealed and secured. Generally the spraying operation and the advancement of the rear tail members can be synchronized so that at no time is any appreciably large region of the wall left exposed. The advancing and spraying operations preferably take place in one operating cycle commencing from the floor region and finishing at the roof. Although it is possible to create a permanent lining of full thickness by this method directly it is preferable to incorporate reinforcing mats or the like in the concrete and to also utilize supports arranged inside the rear tail members. These supports, conveniently of ring-like configuration, can then be incorporated in the final lining. To facilitate the concreting work it is desirable to arrange for the rear tail members to be shifted independently of their drive members.

Thus the invention also provides apparatus for driving tunnels or the like which comprises a plurality of drive members, frame means supporting the drive members for individual displacement, means for advancing the drive members and the frame means in succession whereby to effect the driving operation, rear tail members each associated with a respective one of the drive members, the rear tail members collectively forming a rear shield for supporting the tunnel wall, and independent means for displacing the rear tail members in the advancing direction and in relation to the drive members.

Preferably the rear tail members are retractible and extendible in relation to their drive members and units, conveniently hydraulic units, can be used for effecting the independent movement of the rear tail members. Each unit may operate one or a group of rear tail members. In each case the concrete lining sections produced by the successively cast strips can have a length approximately the same as the shifting stroke of the units. The units can be housed within the drive members and these drive members may have recesses or spaces for receiving the rear tail members when advanced. The provision for retracting and extending the rear tail members enables the concreting work to be carried out largely independently of the driving work when the drive members are advanced and a lining section can be produced prior to each fresh driving cycle.

It is further expedient to arrange for the individual lining sections or the strips thereof to interlock in a shaped fashion with adjacent sections or strips. This can be achieved by appropriate shaping of the rear end portions of the rear tail members or by staggering the lengths of these members. One form of shaping produces tongues on the rear end portions of the rear tail members which tongues have a length which is approximately the same as one of the ring-like supports to overlap the latter.

The present invention also provides tunnel driving apparatus which comprises a plurality of drive members, frame means supporting the drive members for individual displacement, means for advancing the drive members and the frame means in succession whereby to effect driving of tunnel and rear tail members each associated with a respective one of the drive members and movable therewith, the rear tail members collectively forming a rear shield for supporting the tunnel wall wherein the rear tail members are provided with means for producing a shaped end profile to a concrete lining formed by introducing the concrete in successive strips into the spaces left as the rear tail members are advanced whereby successive concrete linings become shaped-locked to one another.

The invention may be understood more readily and various other features of the invention may become apparent from consideration of the following description.

BRIEF DESCRIPTION OF DRAWINGS

Embodiments of the invention will now be described, by way of examples only, with reference to the accompanying drawings, wherein.

DESCRIPTION OF PREFERRED EMBODIMENTS

Figure 1:
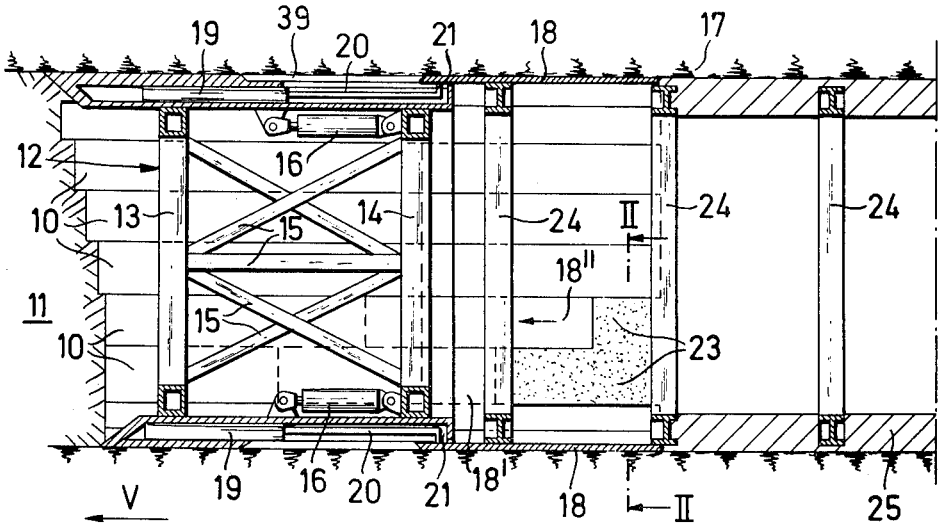
FIG. 1 is a diagrammatic sectional side view of drive shield apparatus made in accordance with the invention.

Referring initially to FIG. 1 a drive shield of tunnelling apparatus comprises a plurality of individual drive members 10 formed with cutting edges at the front ends. These members 10 are arranged side-by-side in a cylindrical array in contact with the tunnel wall at the front end of the tunnel or other excavation. The members 10 are supported and guided for longitudinal displacement on a frame 12. The frame 12 is composed of frame components 13, 14 spaced apart in the tunnel driving direction V and interconnected by longitudinal and diagonal bracing bars 15 to form a rigid assembly. The members 10 are moved in the tunnel driving direction with the aid of hydraulic rams 16 articulated between the rearmost frame component 14 and the members 10. During use, tunnel advancement is effected by pressing the members 10 forward in the driving direction V either individually or in groups by charging the appropriate rams 16 with fluid. The frame 12 and the stationary members 10 in frictional contact with the tunnel wall here act as an abutment for the shifting forces. When all the members 10 have been shifted forwards, the rams 16 are all charged in a reverse sense to draw up the frame 12 and here the members 10 collectively form an abutment for the shifting forces. Spoil or debris from the face 11 can be detached and removed by known ancilliary means (not shown). The constructional and operational features discussed so far are known per se in the art.

A cylindrical rear shield composed of a series of rear tail members 18, complementary to and associated with the drive members 10, is formed behind the drive shield 10, 12. The members 18 are smooth-surfaced arcuate thin plates which are telescopically extendible and retractible with respect to the drive members 10. To each drive member 10 there is allocated a corresponding rear member 18 which is coupled thereto with the aid of a hydraulic piston and cylinder unit 19 capable of displacing the member 18 in relation to its associated drive member 10. The drive members 10 are shaped, e.g. hollow, to accommodate the units 19 in protective box-like spaces therein as shown in FIG. 1. The piston rods 20 of the units 19 are articulated as at 21 to the forward ends of the members 18 and the cylinders of the units 19 are also preferably articulated to the members 10. The members 18 serve to support the tunnel wall 17 behind the drive shield 10, 12 and each member 18 can be drawn-up forwardly in the tunnel driving direction V by operating the associated unit 19. The drive members 10 are slotted to permit the coupling joints 21 to move therealong and the drive members 10 are shaped over their rear end portions to provide spaces 39 for receiving the members 18.

Figure 2:
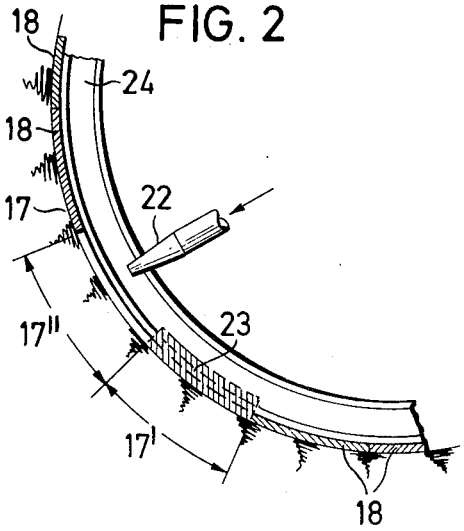
FIG. 2 is a sectional end view of part of the apparatus of FIG. 1, the view being taken along the line II—II of FIG. 1 and illustrating the creation of a tunnel wall lining.
Figure 3:
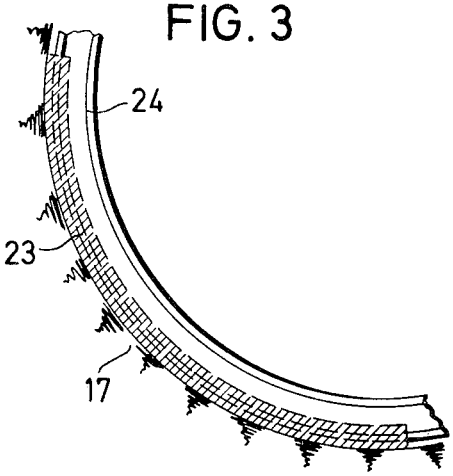
FIG. 3 is a sectional end view of part of the apparatus corresponding to FIG. 2 but depicting a later stage during the creation of the tunnel wall lining.

Apparatus constructed as described permits support of the tunnel wall 17 behind the drive shield, 10, 12 by the creation of a lining in situ by spraying a sealing and supporting composition, usually fluid concrete. The sprayed lining is supplemented at least during its formation by supports 24 as described in more detail hereinafter. The creation of the tunnel lining can take place largely independently of the driving work. As represented in FIGS. 2 and 3 the spray nozzle 22 of a concrete spraying device serves to spray fluid concrete onto the strip section of the tunnel wall exposed when one of the members 18 is moved up in the direction of arrow V.

FIG. 1 shows in the lower floor region a member 18′ which has been drawn forwards by the associated unit 19. Concurrently with this advance or shortly thereafter a strip 23 of sprayed concrete is applied to the part 17′ of the tunnel wall 17 exposed by the advanced member 18′ with the end of the nozzle 22 as shown in FIG. 2. After this operative sequence the next adjacent member 18″, for example, is advanced in the direction of arrow V (FIG. 1) and again the nozzle 22 is used to apply another strip of concrete to the newly exposed part 17″ of the tunnel wall as shown in FIGS. 1 and 2. By this sequence, a concrete lining can be built up strip-by-strip and the wall 17 is at no time left unsupported or unsealed for any appreciable length of time. Normally the concrete strips would be built up in stages from the floor to the roof. The full support for the wall 17 is effected with the additional aid of the supports 24 of ring-like form. Each support 24 can be an integral ring or a series of arcuate segments interconnected to form a ring. The supports 24 are introduced into the rear shield within the members 18 during the tunnel driving operation and reinforcing mats (not shown) may be laid onto the supports 24 adjacent the members 18 and incorporated into the lining formed by the successively cast concrete strips. As shown in FIG. 1, the supports 24 combine with the concrete lining 25 in producing a permanent support for the tunnel wall. Instead of employing spaced-apart supports 24 as represented in the drawings it is possible to provide lightweight tubes or cylinders which are installed end-to-end. The use of a concrete spraying device can also be dispensed with if elements conveniently of arcuate form and made from pre-cast concrete or some other material are installed against the portions of the tunnel wall 17 exposed as one or several members are advanced in a group. Normally the lining would be built up as described hereinbefore, i.e., from the floor to the roof. The support work involving, inter alia, the successive retraction of the members 18 would normally finish when the members 18 have all been retracted up into their drive members 10. Thereafter the driving work involving the successive advance of individual drive members 10 or groups of such members 10 by operation of the rams 16 would also involve rearward extension of the associated members 18 with the aid of the unit 19. Thus, when all the drive members 10 have been advanced the rear shield composed of the extended members is supporting the wall 17 ready for the introduction of the supports and concreting work necessary to form the lining.

Figure 4:
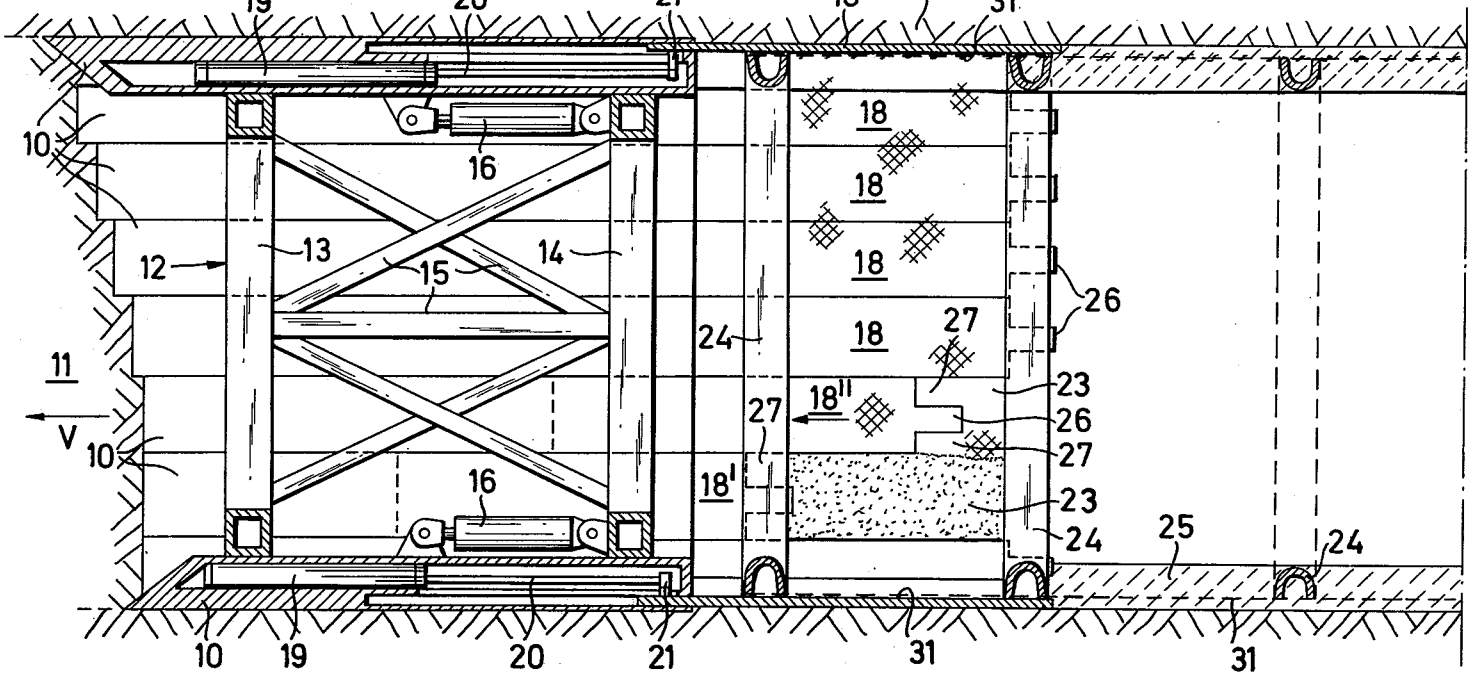
FIG. 4 is a diagrammatic sectional side view of a further form of drive shield apparatus made in accordance with the invention, the view being taken on a somewhat larger scale to that of FIG. 1.
Figure 5:
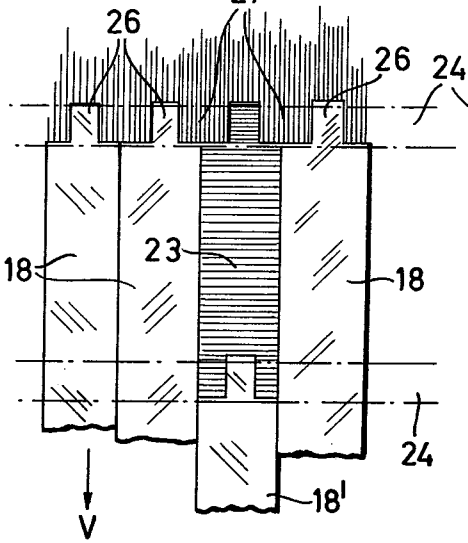
FIG. 5 is a plan view of an end part of the apparatus shown in FIG. 4 illustrating the rear tail members thereof.

The apparatus represented in FIG. 4, generally corresponds to that represented in FIG. 1 and like reference numerals are used to denote the same features. The rear members 18 in FIG. 4 engage on supports 24 of ring-like form introduced in the space defined within the members 18. The supports 24 are spaced apart by a distance which is approximately the same as the stroke of the units 19. Reinforcing mats 31 are also introduced into the space defined within the members 18 and on to the supports 24. As before, concrete is sprayed onto the wall 17 in strips with a length conforming to the stroke of the units 19 and to the spacing between adjacent supports 24 as the members 18 are advanced. In this way a continuous lining 25 incorporating the supports 24 and the mats 31 can be built up. In contrast to the apparatus depicted in FIGS. 1 to 3, the apparatus of FIG. 4 employs rear tail members 18 with shaped rear ends. Thus, as shown in FIGS. 4 and 5, each member 18 has a reduced end portion forming a central tongue 26 with recesses 27 at both sides. The length of the tongues 26, i.e., longitudinally of the members 18, is approximately the same as the width of the supports 24. Since the stroke of the units 19 is substantially the same as the spacing between adjacent supports 24, the tongue 26 of each member 18 can be made to overlap with one of the supports 24 when the member 18 is fully extended or retracted. As the member 15 in question is advanced up, i.e., retracted, (see 18', 18'' FIGS. 4 and 5) the corresponding opening 23 which receives the sprayed concrete includes the recesses 27 and consequently the front end of the resultant concrete strip is profiled with a tooth-like recess corresponding to the tongue 26 of the member 18. This recess is filled with the subsequent concrete strip and in this way the individual concrete strips correspond to each cycle of movement of the members 18 and interlock with one another at their ends forming enhanced stability. These features also serve to stabilize the supports 24.

Figure 6:
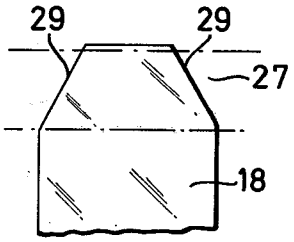
FIGS. 6 to 8 show alternative shapes for the rear ends of the rear tail members of the shield apparatus.
Figure 7:
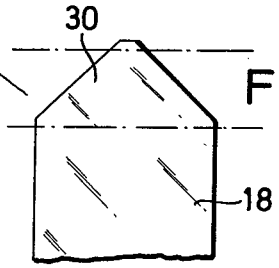
Figure 8:
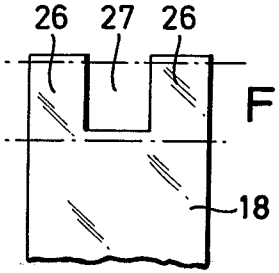

FIGS. 6 to 8 show alternative shapes for the rear ends of the members 18. Thus in FIG. 6, the rear end portion of one of the members 18 has tapered or bevelled sides 29 so that a somewhat trapezoidal profile is produced. In FIG. 7 the rear end portion 30 of one of the members 18 has a triangular profile again producing recesses at the side.

In FIG. 8, the rear end portion of one of the members 18 has a pair of tongues 26 defining a central recess 27 therebetween. In all these constructions the same principle would apply and the recesses defined by the shaped rear end portions of the members 18 will become filled with concrete and the thus-shaped concrete strips interlock.

Figure 9:
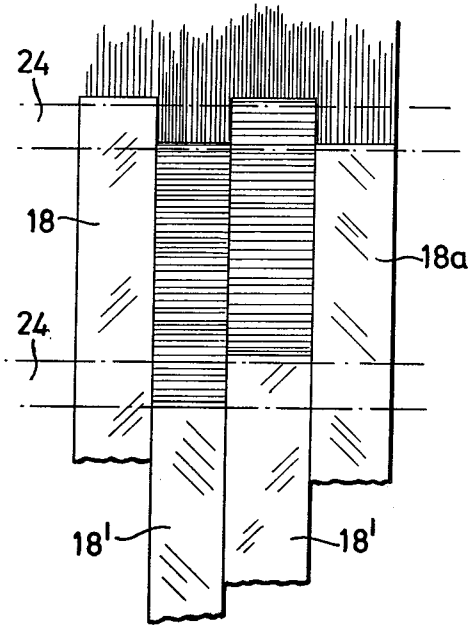
FIG. 9 is a plan view of a modified end part of the apparatus shown in FIG. 4 where staggered real tail members are employed.

FIG. 9 depicts a further modified construction in which the rear tail members 18 have different lengths in a staggered manner with a shorter member 18 disposed between two longer members 18. The difference in length between the shortest and longest members 18 is made approximately equal to the width of the supports 24. When all the members 18 are fully extended in the rearward sense every second member 18 extends over the rearmost support 24 while the other members **18*a* are displaced therefrom in the forward direction. By successive advance of the members (18') and by spraying concrete in strips as described the inherent difference in length between adjacent members 18** will produce a lining section with a tooth-like profile which will again interlock with the next lining section.

Other shapes for the members 18 can be adopted to produce the aforementioned interlocking of the individual lining strips or sections. It may be desired to also impart a slight taper to the members 18 so that they narrow in width in the rearward direction. This will facilitate the shifting of the members 18.

Although the provision for displacing the members 18 in relation to their associated drive members 10 is a preferred useful feature it is not absolutely essential and the method of the invention can be carried out with the members 18 fixed or more preferably pivotably linked to their associated members 10.

We claim:

1. In a method of driving a tunnel or the like which utilizes a drive shield with a plurality of drive members individually displaceable and supported by frame means, and elongated rear tail members associated and movable with the drive members, creating a lining for the tunnel to the rear of the drive shield, characterized by:

(a) successively advancing the elongated rear tail members, and (b) introducing concrete in successive strips into the spaces left as the elongated rear tail members are successively advanced.

2. A method according to claim 1, wherein in one operating cycle the rear tail members are advanced in succession from the floor to the roof and the lining is built up from strips similarly introduced from the floor to the roof.

3. A method according to claim 1, and further comprising arranging supports within the space defined within the rear tail members prior to the introduction of the concrete.

4. A method according to claim 3 and further comprising arranging reinforcements on the supports and introducing the concrete to incorporate these reinforcements and at least part of the supports in the lining.

5. A method according to claim 1, wherein the concrete is introduced by spraying.

6. A method according to claim 1 further comprising forming the concrete strips with shaped ends to provide shaped interlocking between the lining section produced in successive operating cycles.

7. A method according to claim 1, wherein the rear tail members are advanced independently of their associated drive members.

8. Tunnel driving apparatus, comprising: a plurality of drive members, frame means supporting the drive members for individual displacement, means for advancing the drive members and the frame means in succession whereby to effect the driving operation, a plurality of elongated rear tail members each associated with a respective one of the drive members, the rear tail members collectively forming a rear shield for supporting the tunnel wall, a plurality of hydraulic piston and cylinder units for successively and individually displacing the rear tail members in the advancing direction and in relation to the drive members, and means for applying concrete in successive strips into the spaces left as the rear tail members are advanced to create a lining composed of said successive strips.

9. Apparatus according to claim 8, wherein the rear tail members are retractible and extendible in relation to the drive members.

10. Apparatus according to claim 8, wherein spaced-apart supports are arranged in the rear shield and are incorporated, at least partially, in the lining.

11. Apparatus according to claim 10, wherein reinforcements are also arranged in the rear shield and are incorporated in the lining.

12. Apparatus according to claim 8, wherein the rear tail members have reduced rear end portions which produce shaped ends on the concrete strips whereby a shaped interlocking occurs between the lining sections corresponding to successively produced strips.

13. In a method of producing a lining for an underground tunnel or the like by introducing fluid concrete into a region at the rear side of a drive shield, the improvement characterized by: introducing fluid concrete in successive strips side-by-side to combine and form a continuous lining, each strip corresponding to the gap left when an elongated rear tail extension of one of the drive members of the shield is advanced.

14. In apparatus for driving tunnels or the like which comprises a drive shield with a plurality of drive members arranged side-by-side and supported for individual advancement by a frame and a rear shield composed of elongated rear tail extensions allocated to and movable with the respective drive members; the improvement comprising: a plurality of units individually coupled between the rear tail extensions and the associated drive members to permit the rear tail extensions to be drawn up to overlap the drive members and to be extended rearwardly thereof in a supporting position, whereby a lining can be created by forming a succession of concrete strips each corresponding to the gap left when one of the rear extensions is drawn up.

15. Tunnel driving apparatus comprising a plurality of drive members, frame means supporting the drive members for individual displacement, means for advancing the drive members and the frame means in succession whereby to effect driving of the tunnel, and a plurality of elongated rear tail members each associated with a respective one of the drive members and movable therewith, the rear tail members collectively forming a rear shield for supporting the tunnel wall, the rear tail members being provided with reduced rear end portions for producing a shaped end profile to a concrete lining formed by introducing the concrete in successive strips into the spaces left as the rear tail members are successively advanced, whereby successive concrete linings become shaped-locked to one another.

16. Tunnel driving apparatus comprising: a plurality of drive members, frame means supporting the drive members for individual displacement, means for advancing the drive members and the frame means in succession whereby to effect the driving operation, rear tail members each associated with a respective one of the drive members, the rear tail members collectively forming a rear shield for supporting the tunnel wall, and independent means for displacing the rear tail members in relation to the drive members, the means for displacing the rear tail members comprising hydraulic piston and cylinder units each of which is operably coupled between one of the drive members and its associated rear tail member, the units being housed within the drive members and the drive members being provided with spaces for receiving the rear tail members when advanced.

17. Tunnel driving apparatus comprising: a plurality of drive members, frame means supporting the drive members for individual displacement, means for advancing the drive members and the frame means in succession whereby to effect the driving operation, rear tail members each associated with a respective one of the drive members, the rear tail members collectively forming a rear shield for supporting the tunnel wall, independent means for displacing the rear tail members in relation to the drive members, and means for applying concrete in successive strips into the spaces left as the rear tail members are advanced to thereby create a lining, wherein the rear tail members have staggered lengths which produce shaped ends on the lining sections produced by the concrete strips whereby a shaped interlocking occurs between adjacent lining sections.

18. Tunnel driving apparatus comprising: a plurality of drive members, frame means supporting the drive members for individual displacement, means for advancing the drive members and the frame means in succession whereby to effect the driving operation, rear tail members each associated with a respective one of the drive members, the rear tail members collectively forming a rear shield for supporting the tunnel wall, independent means for displacing the rear tail members in relation to the drive members, and means for applying concrete in successive strips into the spaces left as the rear tail members are advanced to thereby create a lining, wherein the rear tail members have shaped rear end portions constituted by at least one tongue at the rear end portion of each rear tail member, said tongues producing shaped ends on the concrete strips, whereby a shaped interlocking occurs between adjacent lining sections.

19. Tunnel driving apparatus comprising: a plurality of drive members, frame members supporting the drive members for individual displacement, means for advancing the drive members and the frame means in succession whereby to effect the driving operation, rear tail members each associated with a respective one of the drive members, the rear tail members collectively forming a rear shield for supporting the tunnel wall, independent means for displacing the rear tail members in relation to the drive members, and means for applying concrete in successive strips into the spaces left as the rear tail members are advanced to thereby create a lining, wherein the rear tail members have tapered rear end portions which produce shaped ends on the concrete strips, whereby a shaped interlocking occurs between adjacent lining sections.

20. Tunnel driving apparatus comprising: a plurality of drive members, frame means supporting the drive members for individual displacement, means for advancing the drive members and the frame means in succession whereby to effect the driving operation, rear tail members each associated with a respective one of the drive members, the rear tail members collectively forming a rear shield for supporting the tunnel wall, independent means for displacing the rear tail members in relation to the drive members, and means for applying concrete in successive strips into the spaces left as the rear tail members are advanced to thereby create a lining, wherein spaced-apart ring supports are arranged in the rear shield and are incorporated at least partially in the lining, and wherein the rear tail members have tongues at their rear ends which have a length in the advancing direction substantially the same as the width of one of said supports, said tongues serving to shape the concrete strips to produce a shaped interlocking between successive co-linear concrete strips.

* * * * *